US007690546B2

(12) United States Patent
Cortez

(10) Patent No.: US 7,690,546 B2
(45) Date of Patent: Apr. 6, 2010

(54) PNEUMATIC TOOL ACTUATION DEVICE

(75) Inventor: Genaro O. Cortez, Bolingbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/848,667

(22) Filed: Aug. 31, 2007

(65) Prior Publication Data

US 2009/0057367 A1 Mar. 5, 2009

(51) Int. Cl.
*B25C 5/13* (2006.01)
*F41A 19/10* (2006.01)
*F41A 19/16* (2006.01)

(52) U.S. Cl. ..... 227/130; 227/129; 227/8; 89/27.3; 251/324

(58) Field of Classification Search ..... 227/8, 227/129, 130; 89/27.3; 42/89.01; 251/324
See application file for complete search history.

(56) References Cited

U.S. PATENT DOCUMENTS 3,272,267 A * 9/1966 Langas ..... 173/170
3,563,438 A * 2/1971 Doyle et al. ..... 227/8
3,653,299 A * 4/1972 Howard ..... 91/416
3,796,270 A * 3/1974 Lange ..... 173/15
3,815,627 A * 6/1974 Farrell et al. ..... 137/486
3,828,458 A * 8/1974 Skone-Palmer ..... 42/69.01
4,122,904 A * 10/1978 Haytayan ..... 173/15
4,196,833 A * 4/1980 Haytayan ..... 227/8
4,385,297 A * 5/1983 Schmitt et al. ..... 340/870.31
4,448,338 A * 5/1984 Graf et al. ..... 227/8
4,509,669 A * 4/1985 Elliesen ..... 227/130
4,932,313 A * 6/1990 Gutknecht ..... 92/181 R
5,410,942 A * 5/1995 Begneu ..... 89/27.14
6,722,547 B1 * 4/2004 Wang et al. ..... 227/8
6,837,415 B1 * 1/2005 Huang ..... 227/130
7,228,917 B2 * 6/2007 Davis et al. ..... 173/170
2007/0074882 A1 * 4/2007 Davis et al. ..... 173/18
2008/0190988 A1 * 8/2008 Pedicini et al. ..... 227/130

OTHER PUBLICATIONS

"DUO-FAST, Nailers Staplers Fasteners, Safety, Operation & Instruction Manual, Pneumatic Fastening Systems" 2000, DUO-FAST Corporation Form No. Manual Pneumatic, Nov. 2000.

* cited by examiner

*Primary Examiner*—Rinaldi I. Rada
*Assistant Examiner*—Gloria R. Weeks
(74) *Attorney, Agent, or Firm*—Mark W. Croll; Christopher Rauch; Levenfeld Pearlstein, LLC

(57) ABSTRACT

The present invention is directed to a pneumatic tool actuation device comprising a housing configured to be attached to a pneumatic tool, a piston slidably moveable within a drive chamber formed within the housing and an air inlet chamber formed within housing and configured to accept a pressurized gas and direct it to the drive chamber. The piston further comprises an O-ring disposed in an annular groove formed in the piston and forming a seal between the piston and the drive chamber. The air inlet chamber is operably connected to a hose through which a pressurized gas travels and enters the housing to move the piston. The movement of the piston actuates a trigger located on the pneumatic tool.

15 Claims, 7 Drawing Sheets

PNEUMATIC TOOL ACTUATION DEVICE

BACKGROUND OF THE INVENTION

The present invention relates to pneumatic tools. Specifically, the present invention is directed to an pneumatic tool actuation device.

Pneumatic tools are becoming increasingly common in many industries including the construction industry. Examples of pneumatic tools include pneumatic nailers, jackhammers, riveters, and the like. The operation of most pneumatically operated tools is relatively simple: compressed air from an air compressor flows through a tube into the housing of the pneumatic tool and the pressure of the compressed air is used to force movement of a piston or other mechanism in the tool to do work.

A pneumatic tool typically is activated by depressing a trigger to drive nails, rivets, staples, or similar fasteners. In automated applications, actuation devices are used to depress the trigger of the pneumatic tool. These actuation devices, though, can be large and involve complicated assembly. Known actuation devices use elaborate pulley systems; these devices, however, can be heavy and sometimes can interfere with the use of the tool.

Accordingly, there is a need for a simple, easy to use, lightweight trigger actuation device. Desirably, such an actuator can be made of a lightweight material and able to withstand fast, repetitive use. More desirably, such an actuator is readily made and usable, and has a high degree of integrity at minimal cost.

BRIEF SUMMARY OF THE INVENTION

The present invention is directed to a pneumatic tool actuation device. The device comprises a housing configured to attach to a pneumatic tool, a piston slidably moveable within a drive chamber formed within the housing, and an O-ring disposed in a groove formed in the piston and forming a seal between the piston and the drive chamber. The housing has a gas inlet/outlet which is configured to be connected to a hose through which a gas travels and enters the drive chamber to slidably move the piston within the drive chamber. The movement of the piston actuates a trigger on the pneumatic tool.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
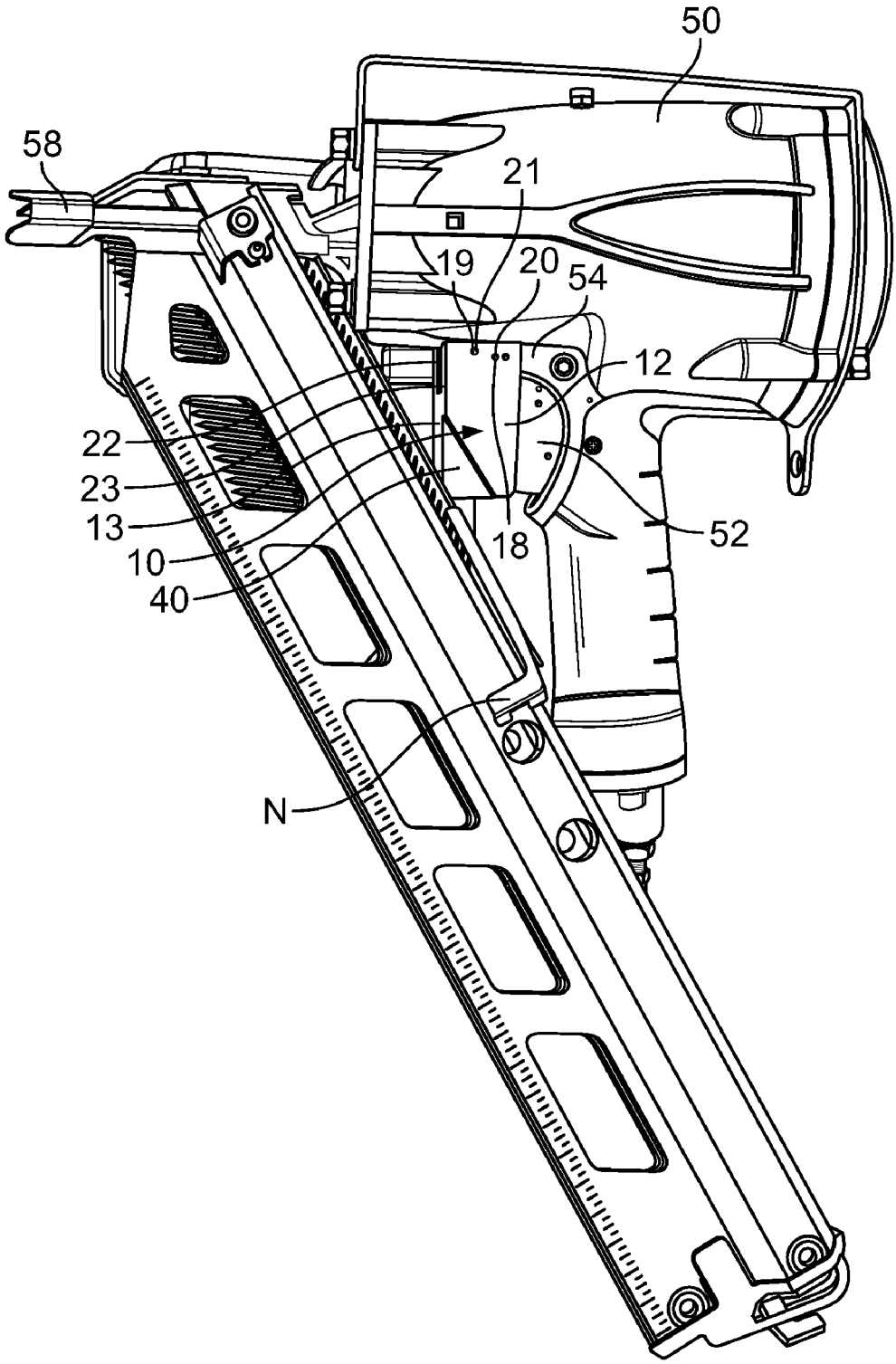
FIG. 1 is a left side view of the pneumatic tool actuation device in the preferred embodiment of the present invention shown attached to a pneumatic tool.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention," relates to a requirement of the United States Patent Office, and does not imply, nor should be inferred to limit the subject matter disclosed herein.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

The present invention pertains to an actuation device configured to depress a trigger on a pneumatically driven tool as illustrated in the figures. The actuation device 10 can be used on a pneumatic nailer as shown; however, it is also contemplated that the actuation device 10 can be used on other pneumatic tools and such uses should be considered to be within the scope of this invention. The actuation device 10 is configured to depress the trigger 52 on the pneumatic tool 50 when device 50 is actuated, thereby actuating the pneumatic tool 50.

Figure 5:
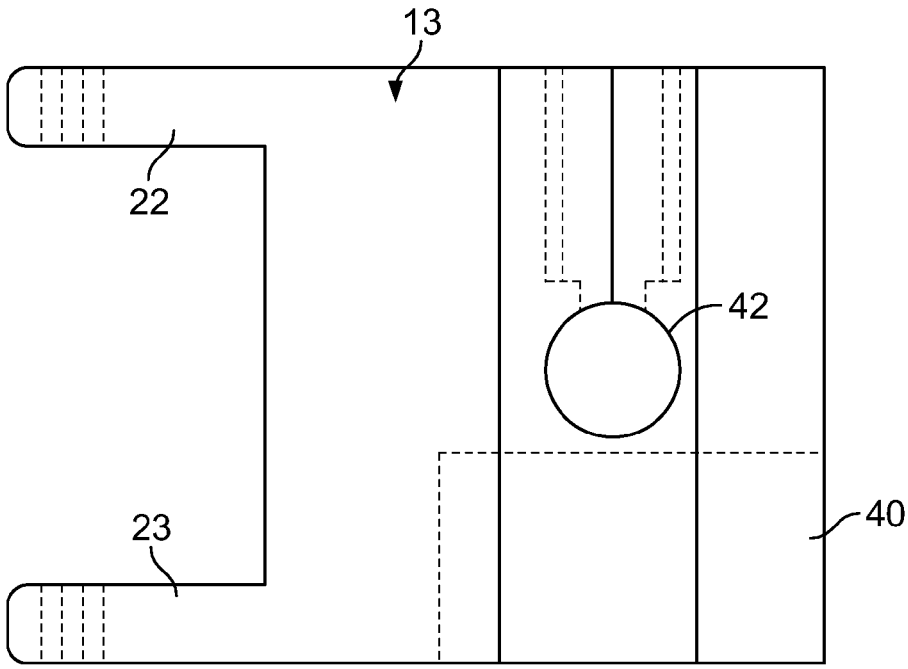
FIG. 5 is a top plan view of the actuation device of the present invention.
Figure 6:
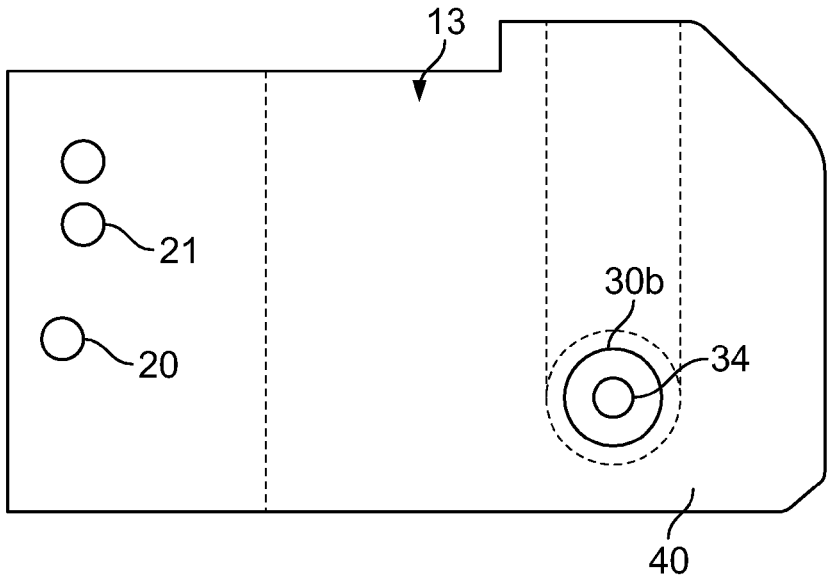
FIG. 6 is a right side plan view of the actuation device of the present invention.
Figure 6A:
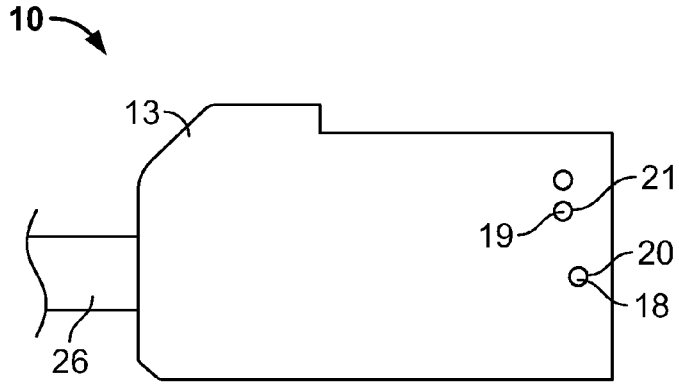
FIGS. 6A and 6B are right and left side views, respectively, of the actuation device of the present invention.
Figure 6B:
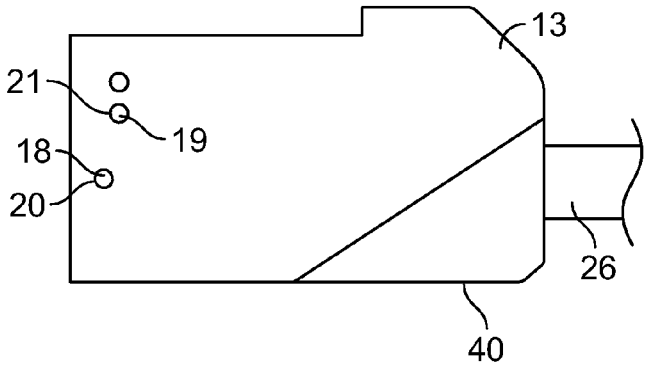

The actuation device 10 is comprised of a housing 12 having a piston 14 disposed therein. The actuator housing 12 is a one-piece unit composed of a main body 13 and integral actuator attachment arms 22, 23 as seen in FIGS. 5 and 6. In one embodiment, as shown in the figures, the housing is configured to be used with a pneumatic nailer, such as the Duo-Fast nailer available from Duo-Fast Corporation in Elgin, Ill., an Illinois Tool Works company. Preferably, the housing 12 is formed of a strong, durable, lightweight material, such as aluminum.

In the preferred embodiment, the main body 13 of the housing 12 has a triangular-shaped clearance cutout 40 formed on an outer surface to accommodate the follower N (nail pusher) on the pneumatic nailer 50 as follower N moves toward the front or disbursal section of the nailer 50 as the nail count in the magazine is depleted.

A drive chamber 42 is formed as a cylindrical bore extending partially through the main body 13 of the actuator housing 12, as shown in FIGS. 4-7. A piston 14 is disposed and slidably movable within the cylindrical drive chamber 42. The piston 14 is made from brass in the present embodiment, but other materials such as iron or steel or plastics or composites thereof are also contemplated. The material of the piston 14 should be capable of withstanding continuous and repetitive strikes/stresses as well as stresses due to friction.

Actuator attachment arms 22, 23 are integral with the main body 13 of the actuator housing 12. The actuator arms 22, 23 are spaced apart, allowing for the attachment arms 22, 23 to straddle the trigger housing 54.

Figure 7:
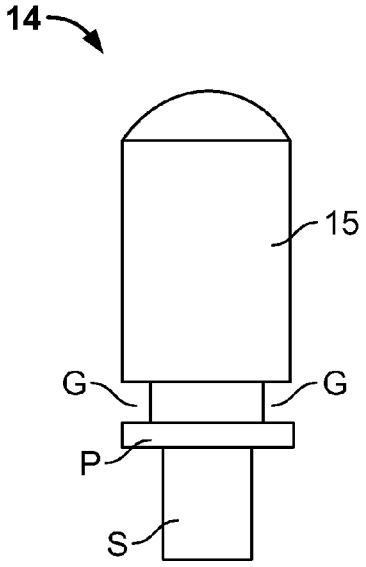
FIG. 7 is a side view of the piston element of the present invention.

As shown in FIG. 7, the piston 14 has a piston head 15 which is configured to extend outwardly from actuator housing 12 through the opening formed by drive chamber 42. In its non-actuated state, the piston head 15 is configured to lie adjacent or in close proximity to the trigger 52 when the actuator 10 is attached to the pneumatic tool 50.

The piston 14 comprises a piston head 15, a groove G, a support plate P, and a shaft S. An O-ring 16 is disposed in the groove G of the piston 14. The O-ring 16 acts as a seal or gasket to prevent air from escaping up along the sides of the drive chamber 42, between the piston 14 and the drive chamber 42. It is contemplated that the material used for the O-ring is suitable for extremes in temperature and capable of withstanding repetitive movement and/or vibration, such as a rubber O-ring as is known in the art.

As shown in FIGS. 5 and 6, an air inlet chamber 34 is formed as a cylindrical bore extending partially through the main body 13 of the actuator housing 12, intersecting with and generally normal to drive chamber 42, and is configured to accept a pressurized gas and direct it to the drive chamber 42, as further discussed below.

The actuator 10 is attached to the pneumatic tool 50 by pins 18, 19. The pins 18, 19 attach the actuator housing 12 to the trigger housing 54 through pin holes 20, 21 in the actuator housing 12 and through the trigger housing holes 56, 57. It is anticipated that the pneumatic tool 50 has pre-formed holes in the trigger housing 54 to accept pins 18. However, those skilled in the art will recognized that holes may need to be formed in other pneumatic tools to attach the actuator 10 or that other attachment methods may be required depending on the design of the particular pneumatic tool.

Figure 2:
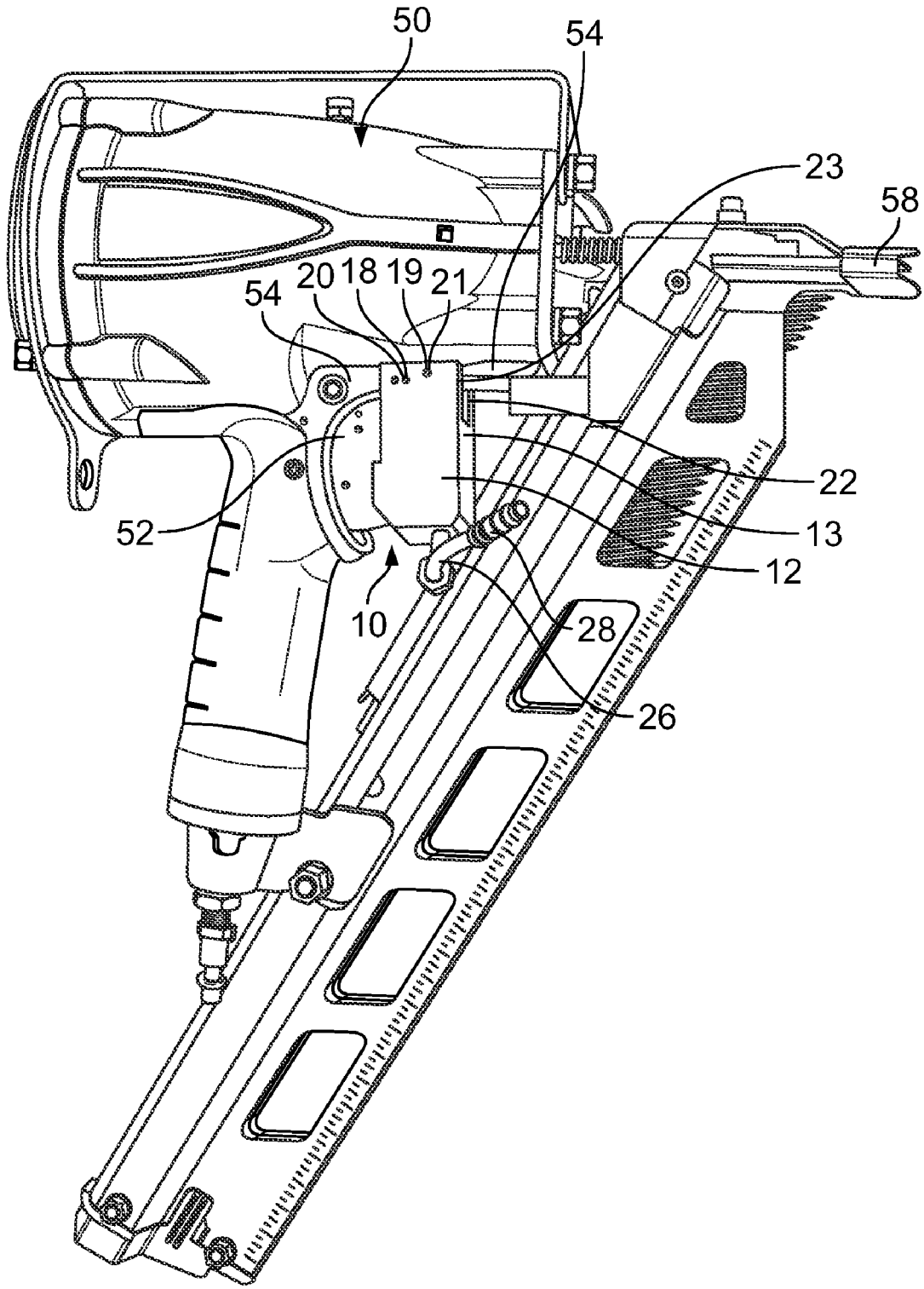
FIG. 2 is a right side view of the actuation device of the present invention aft ached to a pneumatic tool.
Figure 3:
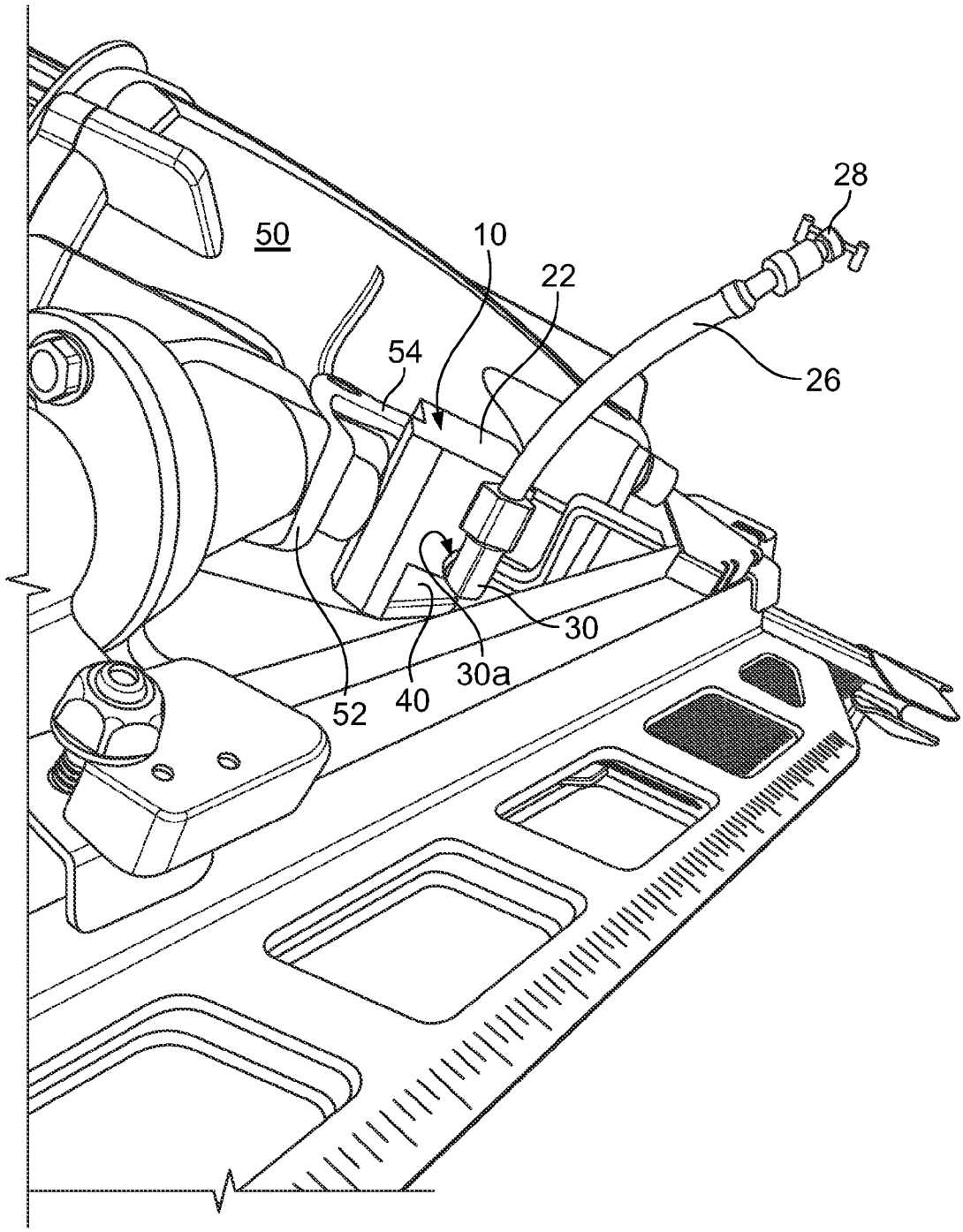
FIG. 3 is a bottom perspective view of the actuation device of the present invention attached to a pneumatic tool.
Figure 4:
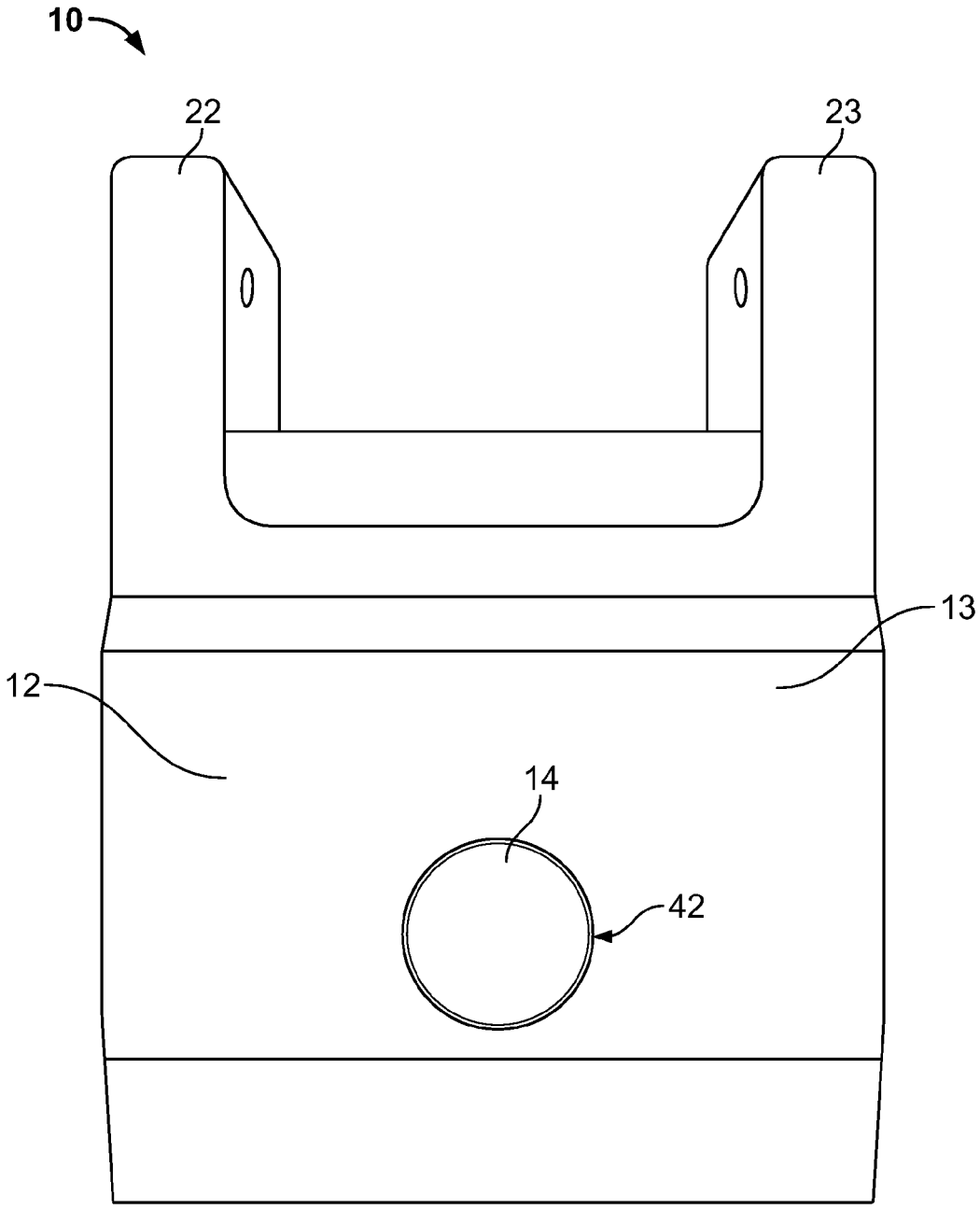
FIG. 4 is a top perspective view of the actuation device of the present invention.
Figure 4A:
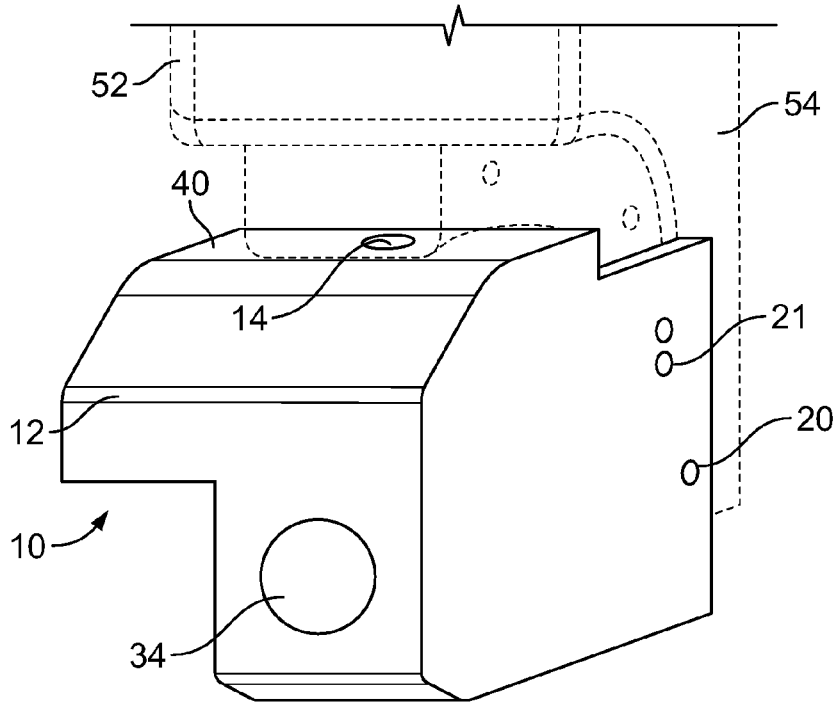
FIGS. 4A and 4B are perspective views of the actuation device of the present invention.
Figure 4B:
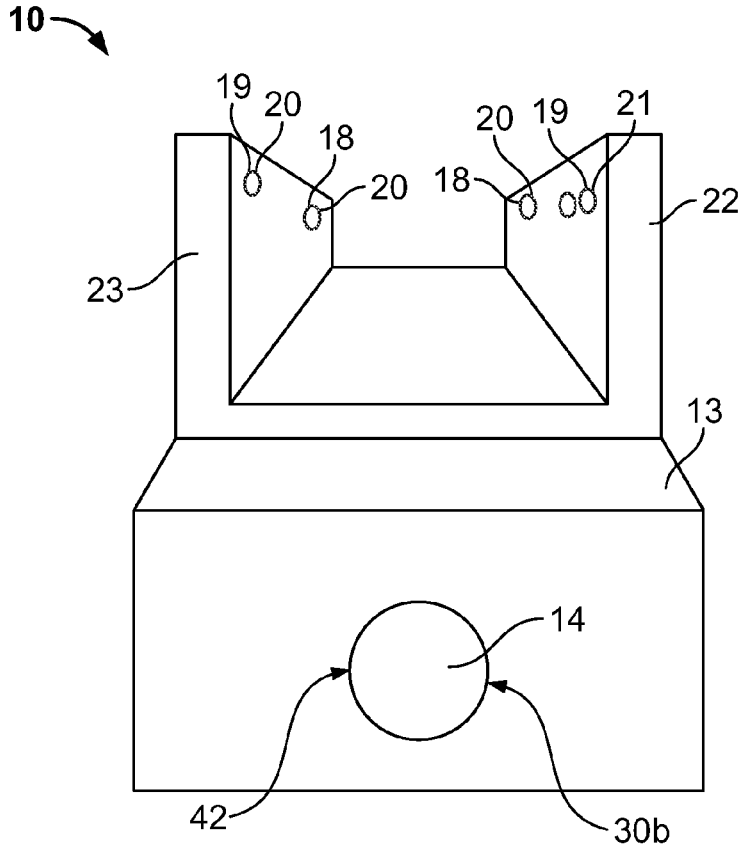

Looking to FIGS. 2 through 4, the actuator 10 is shown with a hose 26 that carries air from a compressor (not shown) to the actuation device 10. The hose 26 has two ends, a compressor end 28 that connects the hose 26 to the air compressor, and an actuator end 30, which comprises a brass elbow connector in the present embodiment, which connects the hose 26 to the actuator 10 at opening 30*b* (FIG. 6) on the main body 13 of the actuator housing 12 formed by the air inlet chamber 34.

Air from the compressor is pressurized; therefore, when a control valve is opened, or when a signal from a control system activates, air flows from the compressor through the hose 26, through air inlet chamber 34 and into the drive chamber 42 of the actuator 10. The pressurized air in the drive chamber 42 pushes against the support plate P of the piston 14, forcing the piston 14 to move slidably within the drive chamber 42 and toward the trigger 52 of the pneumatic tool 50. The piston 14 then contacts the trigger 52 of the pneumatic tool 50 and depresses the trigger 52, thereby actuating pneumatic tool 50.

After the pneumatic tool 50 is actuated, the air is released from hose 26, and the trigger 52, which is spring-loaded in most pneumatic tools, returns to its original position, forcing the piston 14 to retract and slidably move within the drive chamber 42 toward the housing 12 in preparation for the next actuation. As will be appreciated by those skilled in the art, a shuttle valve may be used in conjunction with the compressor to control the flow of air to and from the actuator 10.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A pneumatic actuation device for a tool having a trigger and a tool housing, the pneumatic actuation device consisting essentially of:

a housing, the housing having a piston drive chamber and an air inlet chamber formed therein, and the housing having a first attachment arm and a second attachment arm, wherein the first and second attachment arms are configured to attach the actuation device to the tool housing at least one pin;

a piston disposed within the piston drive chamber and configured to slidably move within the piston drive chamber, the piston having a piston head and a support plate, a shaft and an annular groove formed between the piston head and the support plate, wherein when the piston is slidably moved to a first position within the piston drive chamber, the piston contacts and actuates the trigger, and when the piston is at a second position, different than the first position, within the piston drive chamber, the piston does not contact nor actuate the trigger, and wherein the piston slidably moves from the first position to the second position by action of the trigger against the piston; and an O-ring, wherein the O-ring is disposed in the annular groove and wherein the O-ring forms a seal between the piston and the piston drive chamber.

2. The pneumatic actuation device of claim 1 wherein the piston drive chamber and the air inlet chamber intersect.

3. The pneumatic actuation device of claim 1 wherein a longitudinal axis of the piston drive chamber is generally normal to a longitudinal axis of the air inlet chamber.

4. The pneumatic actuation device of claim 1 wherein the piston drive chamber is cylindrical.

5. The pneumatic actuation device of claim 1 wherein the air inlet chamber is cylindrical.

6. The pneumatic actuation device of claim 1 wherein the first attachment arm and the second attachment arm are configured to straddle a trigger housing of the pneumatic tool.

7. The pneumatic actuation device of claim 1 wherein a connector for operably engaging a gas supply is disposed at an entrance of the air inlet chamber.

8. The pneumatic actuation device of claim 7 wherein the connector comprises an elbow connector.

9. The pneumatic actuation device of claim 8 wherein a gas from the gas supply enters the piston drive chamber through the air inlet chamber and moves the piston.

10. The pneumatic actuation device of claim 1 wherein the housing is formed of aluminum.

11. The pneumatic actuation device of claim 1 wherein the piston is formed of brass.

12. The pneumatic actuation device of claim 1 wherein the housing further comprises a clearance cutout configured to provide clearance for a moving element of the pneumatic tool.

13. The pneumatic actuation device of claim 1 wherein a gas pushes against the support plate to move the piston.

14. The pneumatic actuation device of claim 13 wherein the gas is air.

15. An automatically actuable pneumatic tool comprising:

a pneumatic tool having a trigger; and a pneumatic tool actuation device mounted to the tool, the actuation device consisting of: an actuation device housing, the actuation device housing having a piston drive chamber and an air inlet chamber formed therein, and the actuation device housing having a first attachment arm and a second attachment arm, wherein the attachment arms are configured to attach the actuation device to the pneumatic tool; a piston disposed within the piston drive chamber and configured to slidably move within the piston drive chamber, the piston having a piston head and a support plate, a shaft and an annular groove formed between the piston head and the support plate, wherein when the piston is slidably moved to a first position within the piston drive chamber the piston actuates the trigger, and when the piston is at a second position, different than the first position, within the piston drive chamber, the piston does not actuate the trigger, and wherein the piston moves from the first position to the second position by action of the trigger against the piston; and an O-ring, wherein the O-ring is disposed in the annular groove and wherein the O-ring forms a seal between the piston and the piston drive chamber.

* * * * *

UNITED STATES PATENT AND TRADEMARK OFFICE

CERTIFICATE OF CORRECTION

PATENT NO. : 7,690,546 B2
APPLICATION NO. : 11/848667
DATED : April 6, 2010
INVENTOR(S) : Genaro O. Cortez It is certified that error appears in the above-identified patent and that said Letters Patent is hereby corrected as shown below:

Column 4, line 10, should read "housing using at least one pin;"

Signed and Sealed this

Eleventh Day of May, 2010

David J. Kappos

David J. Kappos
*Director of the United States Patent and Trademark Office*